US010204748B2

(12) United States Patent
Koyama et al.

(10) Patent No.: US 10,204,748 B2
(45) Date of Patent: Feb. 12, 2019

(54) CONTACT MECHANISM AND SWITCH USING THE SAME

(71) Applicant: OMRON Corporation, Kyoto-shi, Kyoto (JP)

(72) Inventors: Taiki Koyama, Okayama (JP); Makoto Myoka, Kusatsu (JP); Koji Takami, Kyoto (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/682,608

(22) Filed: Aug. 22, 2017

(65) Prior Publication Data

US 2017/0352499 A1 Dec. 7, 2017

Related U.S. Application Data

(63) Continuation of application No. PCT/JP2015/072924, filed on Aug. 13, 2015.

(30) Foreign Application Priority Data

Mar. 13, 2015 (JP) ..... 2015-051160

(51) Int. Cl.

| | |
|---|---|
| ***H01H 1/10*** | (2006.01) |
| ***H01H 9/44*** | (2006.01) |
| ***H01H 9/06*** | (2006.01) |
| ***H01H 9/30*** | (2006.01) |
| ***H01H 13/18*** | (2006.01) |
| ***H01H 33/18*** | (2006.01) |
| ***H01H 50/54*** | (2006.01) |

(52) U.S. Cl.

CPC ..... *H01H 1/10* (2013.01); *H01H 9/06* (2013.01); *H01H 9/443* (2013.01);

(Continued)

(58) Field of Classification Search

CPC ..... H01H 1/10; H01H 1/06; H01H 1/2016; H01H 2001/545; H01H 9/443; H01H 9/46;

(Continued)

(56) References Cited

U.S. PATENT DOCUMENTS 9,552,945 B2 * 1/2017 Britz ..... H01H 33/182
2008/0314721 A1 * 12/2008 Arataki ..... H01H 9/061 200/17 B (Continued)

FOREIGN PATENT DOCUMENTS

CA 2886423 A1 4/2014
CN 1162830 A 10/1997

(Continued)

OTHER PUBLICATIONS

Translation of JP2004273413 (orig. doc. published Sep. 30, 2004).*

(Continued)

*Primary Examiner* — Edwin A. Leon
*Assistant Examiner* — William Bolton
(74) *Attorney, Agent, or Firm* — Metrolexis Law Group, PLLC

(57) ABSTRACT

A contact mechanism includes an opening/closing fixed contact, an opening/closing movable contact opposed to the opening/closing fixed contact, and a permanent magnet configured to extend an arc that occurs between the opening/closing fixed contact and the opening/closing movable contact in a predetermined direction. In particular, an arc that occurs from contact surface regions where the opening/closing fixed contact and the opening/closing movable contact make contact with each other is extended by a magnetic force of the permanent magnet and moved to non-contact surface regions where the opening/closing fixed contact and the opening/closing movable contact make no contact with each other.

7 Claims, 13 Drawing Sheets

(52) U.S. Cl.
CPC ..... *H01H 13/186* (2013.01); *H01H 9/063* (2013.01); *H01H 9/302* (2013.01); *H01H 33/182* (2013.01); *H01H 50/546* (2013.01)

(58) Field of Classification Search
CPC .. H01H 13/186; H01H 33/596; H01H 1/2066; H01H 9/302; H01H 9/34; H01H 50/24; H01H 50/54; H01R 9/18; H01R 4/4809
USPC .... 218/148, 139, 36, 16, 18, 20, 21, 23, 26, 218/40; 200/449; 439/171; 335/83, 97, 335/186
See application file for complete search history.

(56) References Cited

U.S. PATENT DOCUMENTS

| | | | | |
|---|---|---|---|---|
| 2014/0225331 | A1* | 8/2014 | Hozumi | H01H 9/063 277/500 |
| 2015/0034600 | A1 | 2/2015 | Isozaki et al. | |

FOREIGN PATENT DOCUMENTS

| | | | | |
|---|---|---|---|---|
| CN | 104078257 | A | 10/2014 | |
| CN | 104246952 | A | 12/2014 | |
| EP | 2980821 | A1 | 2/2016 | |
| JP | S45-21971 | Y1 | 9/1970 | |
| JP | 2004-273413 | A | 9/2004 | |
| JP | 2005-228526 | A | 8/2005 | |
| JP | 2013-222559 | A | 10/2013 | |
| JP | 2014-197469 | A | 10/2014 | |
| WO | WO2014049011 | * | 4/2014 | H01H 9/44 |

OTHER PUBLICATIONS

The International Search Report of PCT/JP2015/072924 dated Oct. 6, 2015.
English translation of Written Opinion of PCT/JP2015/072924 dated Oct. 6, 2015 from the International Searching Authority.
The Chinese Office Action (CNOA) dated Jun. 26, 2018 in the counterpart Chinese patent application.

* cited by examiner

Electron microscope image 1

Electron microscope image 1

Electron microscope image 1

Electron microscope image 1

Electron microscope image 1

Electron microscope image 1

Electron microscope image 1

Electron microscope image 1

CONTACT MECHANISM AND SWITCH USING THE SAME

CROSS REFERENCE TO RELATED APPLICATIONS

This application is a continuation application of International Application No. PCT/JP2015/072924, filed on Aug. 13, 2015, which claims priority based on the Article 8 of Patent Cooperation Treaty from prior Japanese Patent Application No. 2015-051160, filed on Mar. 13, 2015, the entire contents of which are incorporated herein by reference.

TECHNICAL FIELD

The disclosure relates to a contact mechanism, and particularly, to a contact mechanism for solving a trouble caused by an arc that occurs when contacts are opened.

BACKGROUND ART

Conventionally, for example, there has been a contact mechanism that is used in "a power conversion apparatus including an inverter circuit that converts an output of a DC power supply to AC and supplies the converted AC to a load and a DC disconnector that includes contacts inserted in an electric circuit between the DC power supply and the inverter circuit and blocks power supply to the inverter circuit" (refer to Patent Document 1). In the power conversion apparatus, the DC disconnector includes a switch that brings the contacts into contact with each other or separates the contacts from each other according to an operation of an operation unit and permanent magnets that are disposed at both sides of the contacts outside a switch body so as to form a magnetic field in a direction substantially perpendicular to the direction of the contact and separation between the contacts.

In the contact mechanism, as illustrated in FIG. 10 of Patent Document 1, a movable contact 17 which is disposed on a movable contactor 18 is brought into contact with or separated from a fixed contact 16 by operating a reversing handle 14. Further, in the contact mechanism, permanent magnets 12 are disposed so as to extend an arc that occurs when the movable contact 17 is separated from the fixed contact in a desired direction to eliminate the arc.

PRIOR ART DOCUMENT

Patent Document

Patent Document 1: Japanese Unexamined Patent Publication No. 2005-228526

SUMMARY OF THE INVENTION

Problems to be Solved by the Invention

However, in the above contact mechanism, when the movable contact 17 is separated from the fixed contact 16, an arc that occurs from specific surface regions in the contact surfaces that are separated first is maintained in the specific surface regions. Thus, only the specific surface regions are burn-damaged and become rough by the arc. Accordingly, when the specific surface regions make contact with each other, the electric resistance increases. Thus, disadvantageously, heat generation is likely to occur, and the contact life is also short.

In view of the above problems, one or more embodiments may provide a contact mechanism that does not increase the electric resistance and has a long contact life.

Means for Solving the Problem

In view of the above problems, a contact mechanism according to one or more embodiments includes: a fixed contact; a movable contact opposed to the fixed contact; a permanent magnet configured to extend an arc that occurs between the fixed contact and the movable contact in a predetermined direction. The arc that occurs from contact surface regions where the fixed contact and the movable contact make contact with each other is extended by a magnetic force of the permanent magnet and moved to non-contact surface regions where the fixed contact and the movable contact make no contact with each other.

Effect of the Invention

According to one or more embodiments, the occurred arc is moved to the non-contact surface regions. Thus, the contact surface regions of the fixed contact and the movable contact are less likely to be burn-damaged and do not become rough by the arc. Therefore, the electric resistance is not increased. Accordingly, even if the contact surface regions make contact with each other, heat generation is less likely to occur, and the contact life is extended.

As one or more embodiments, the movable contact may be disposed on a movable touch piece configured to turn.

According to one or more embodiments, it becomes easy to clearly divide the contact surface regions where the fixed contact and the movable contact make contact with each other and the non-contact surface regions where the fixed contact and the movable contact make no contact with each other by a turning motion of the movable touch piece. Thus, the contact surface regions of the fixed contact and the movable contact are further less likely to be burn-damaged and do not become rough by the arc. As a result, the electric resistance is not increased. Thus, even if the contact surface regions make contact with each other, heat generation is further less likely to occur, and the contact life is further extended.

As one or more embodiments, the arc that occurs from the contact surface regions of the fixed contact and the movable contact may be extended by the magnetic force of the permanent magnet to the non-contact surface regions located at a side corresponding to a turning axis of the movable touch piece.

According to one or more embodiments, the arc that occurs from the contact surface regions is extended by the magnetic force of the permanent magnet and moved to the non-contact surface regions. Thus, it is possible to avoid deterioration of the contact surface regions and to further extend the contact life.

As one or more embodiments, the movable contact may be disposed on a movable touch piece configured to parallely move along an opposed direction that intersects a surface of the fixed contact.

According to one or more embodiments, an applicable range is expanded, and the flexibility in design is expanded.

As one or more embodiments, at least either an opposed surface of the fixed contact or an opposed surface of the movable contact may include a tapered surface inclined to expand a distance between the fixed contact and the movable contact from the contact surface regions to the non-contact surface regions during closing of the fixed contact and the movable contact.

The tapered surface according to one or more embodiments may be a flat tapered surface or may also be a curved tapered surface having a projecting cross section or a recessed cross section.

According to one or more embodiments, an arc can be easily moved. Thus, even if the contact surfaces are burn-damaged by the arc, merely the non-contact surface regions are gradually burn-damaged to increase the contact resistance, and the contact resistance of the contact surface regions is not likely to increase. Therefore, the contact life is extended.

A switch according to one or more embodiments may include the above contact mechanism.

According to one or more embodiments, it is possible to obtain a switch that is less likely to generate heat and has a long life.

A trigger switch according to one or more embodiments may include the above contact mechanism.

According to one or more embodiments, a trigger switch is less likely to generate heat and has a long life can be obtained.

MODE FOR CARRYING OUT THE INVENTION

A contact mechanism according to one or more embodiments is applied to a trigger switch as illustrated in the accompanying drawings of FIGS. 1 to 11.

Figure 1:
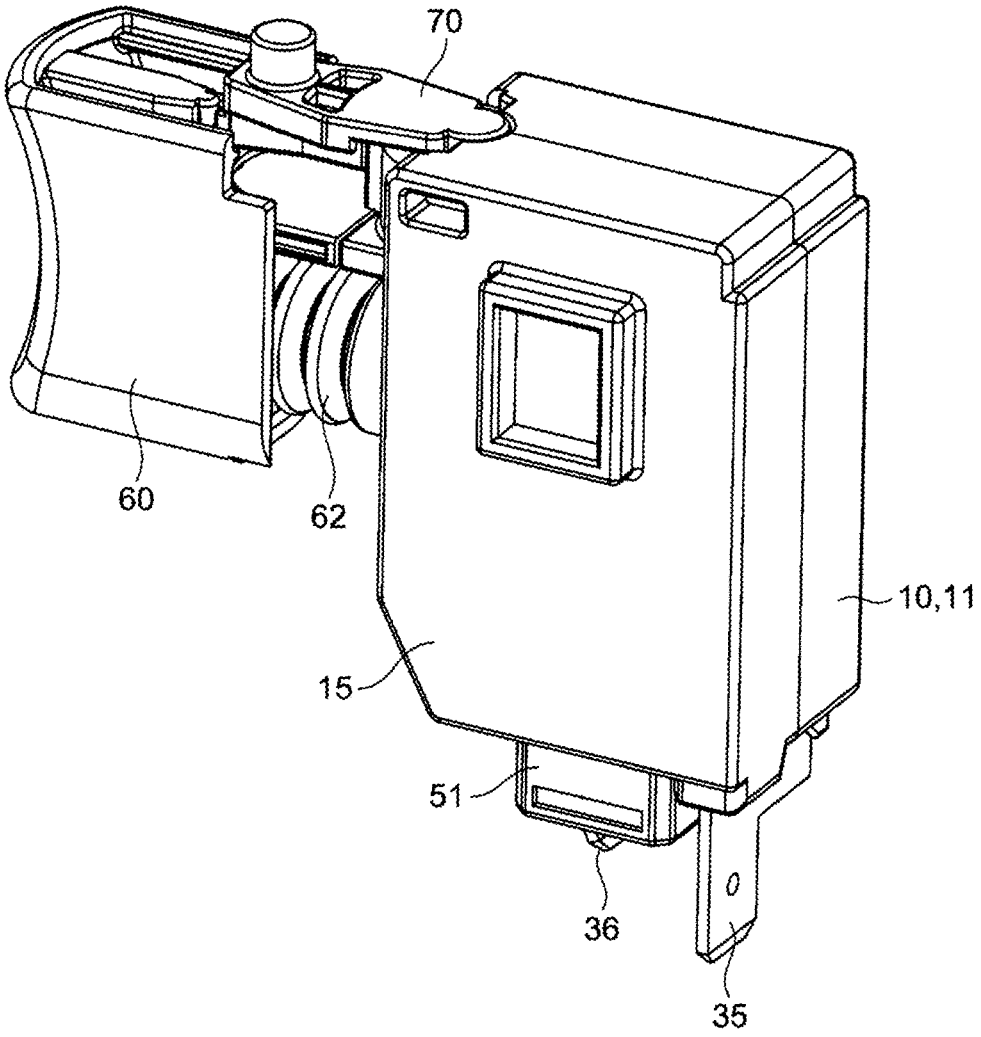
FIG. 1 is a perspective view illustrating a trigger switch of a contact mechanism according to one or more embodiments.
Figure 2:
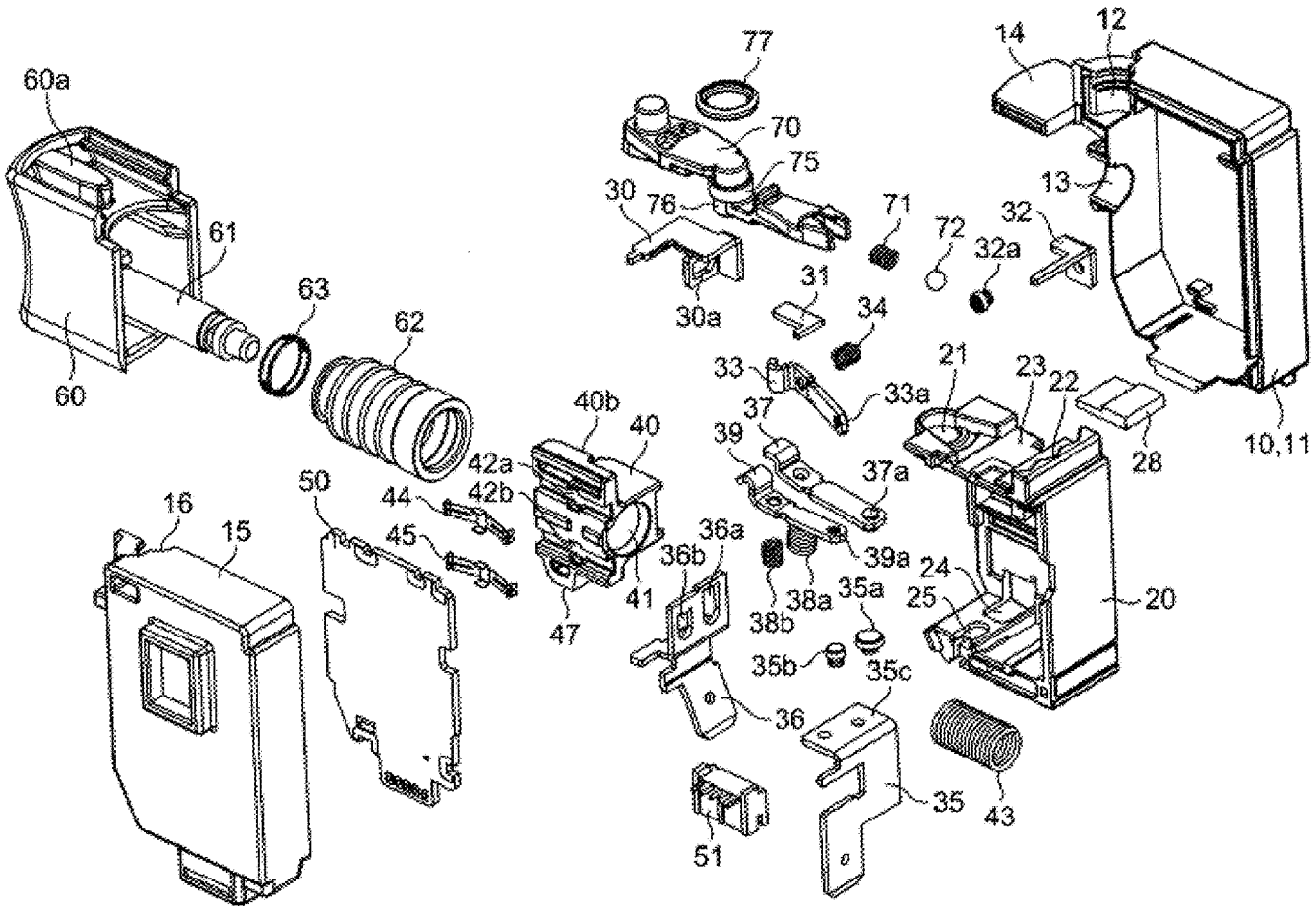
FIG. 2 is an exploded perspective view of a trigger switch, such as in FIG. 1.

Specifically, as illustrated in FIG. 2, a trigger switch according to a first embodiment includes a housing 10 which is formed by combining a first cover 11 and a second cover 15, internal components including a base 20, a plunger 40, and a printed circuit board 50 which are incorporated in the housing 10, and a trigger 60 and a switching lever 70 which are assembled to the housing 10.

In the following description, terms indicating directions such as "upper", "lower", "left", and "right" and terms including these terms are used for describing configurations illustrated in the drawings. However, these terms are used for the purpose of facilitating the understanding of one or more embodiments through the drawings. Thus, these terms do not necessarily indicate directions in which one or more embodiments are actually used, and these terms should not limit the interpretation of the technical scope of the invention described in the claims.

As illustrated in FIG. 2, the first cover 11 is provided with a semicircular fitting recess 12 for supporting the switching lever 70 (described below) on one side of the upper face of the first cover 11. The first cover 11 is further provided with a semicircular rib 13 for supporting an operation shaft 61 of the trigger 60 on the outer side face of the first cover 11 at a position immediately below the fitting recess 12. The first cover 11 is further provided with a guide piece 14 which is adjacent to the fitting recess 12 and laterally projects.

Figure 3:
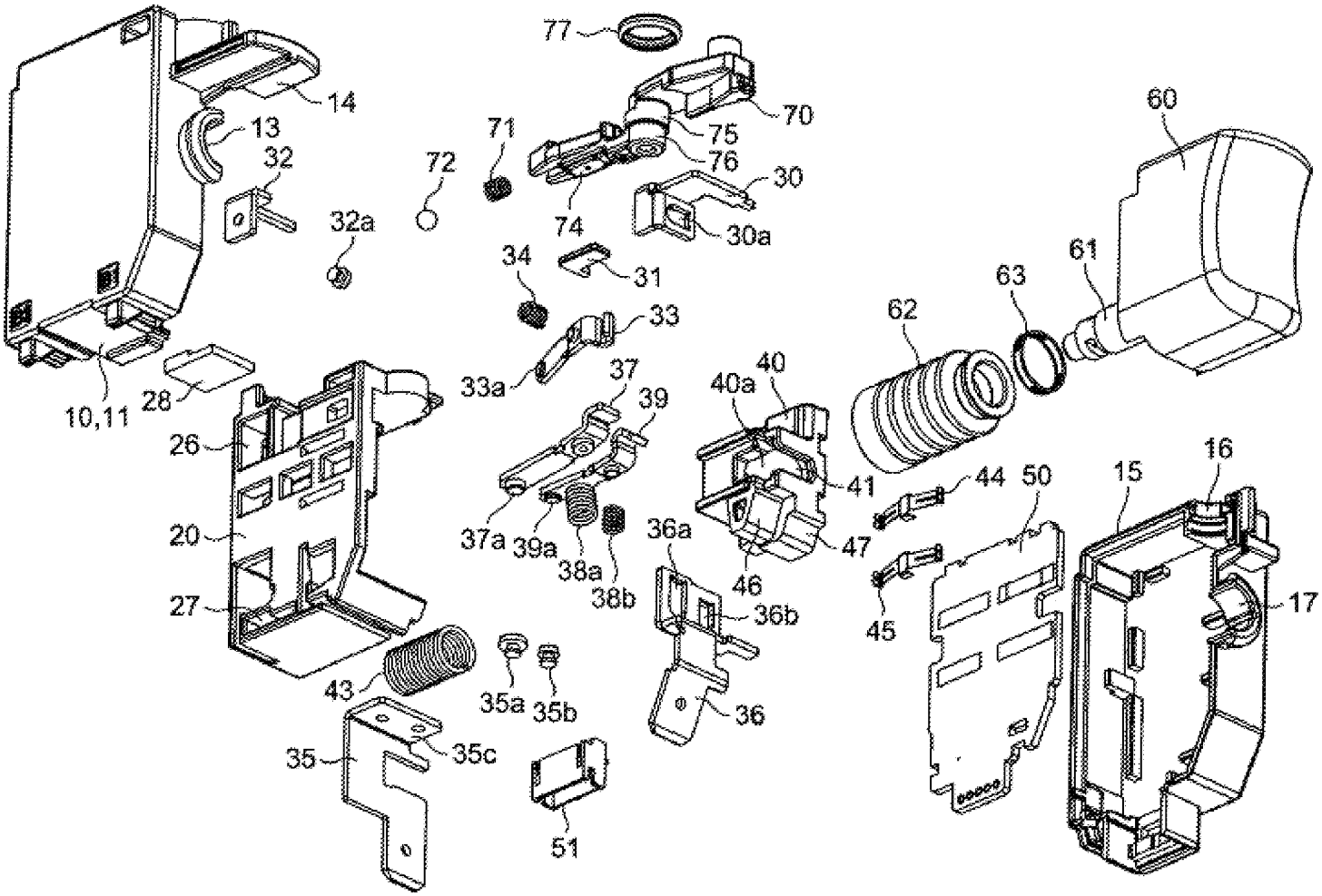
FIG. 3 is an exploded perspective view of a trigger switch viewed from an angle different from that of FIG. 2.
Figure 4:
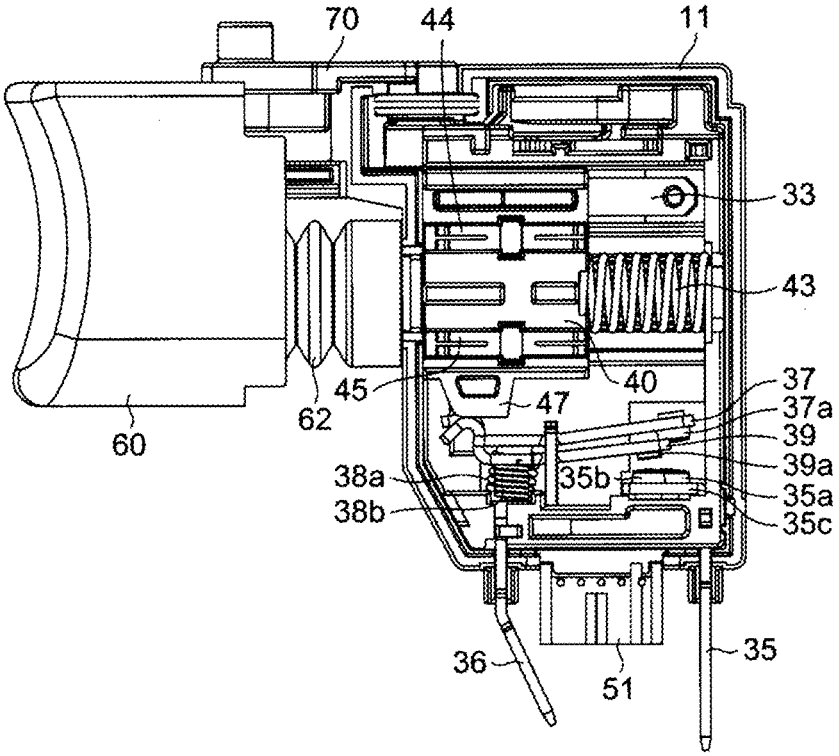
FIG. 4 is a front view illustrating internal components before a trigger switch, such as in FIG. 1, operates.

As illustrated in FIG. 3, the second cover 15 has a front shape that can butt against the first cover 11. The second cover 15 is provided with a semicircular fitting recess 16 for supporting the switching lever 70 (described below) on one side of the upper face of the second cover 15. The second cover 15 is further provided with a semicircular rib 17 for supporting the operation shaft 61 of the trigger 60 on the outer side face of the second cover 15 at a position immediately below the fitting recess 16.

A joint face of the second cover 15, except for a portion to which the operation shaft 61 of the trigger 60 and the switching lever 70 (described below) are attached, is integrated with the first cover 11 by ultrasonic welding or with an adhesive.

As illustrated in FIG. 2, the base 20 has a box shape whose side face on one side is cut away. The base 20 is provided with a positioning recess 21 for positioning the switching lever 70 on one side of the upper side of the base 20. The base 20 is further provided with a click-feeling jagged portion 22 having a saw-tooth shape on the other side of the upper side of the base 20. The base 20 is further provided with a placement recess 23 for placing a common relay terminal 30 and a first relay terminal 31 (both described below) between the positioning recess 21 and the click-feeling jagged portion 22. The base 20 is further provided with a positioning recess 24 for positioning a movable contact spring 38*a* (described below) and a positioning recess 25 for positioning a movable contact spring 38*b* (described below). The positioning recess 24 and the positioning recess 25 are arranged side by side on the bottom face of the lower side of the base 20.

As illustrated in FIG. 2, the common relay terminal 30 having a bent shape and the first relay terminal 31 are placed to be flush with each other in the placement recess 23 of the base 20. The common relay terminal 30 turnably supports a relay movable touch piece 33 which is inserted in a support hole 30*a* of the common relay terminal 30 through a relay movable contact spring 34.

As illustrated in FIG. 3, a second relay terminal 32 which is provided with a relay fixed contact 32*a* is assembled to a fitting hole 26 of the base 20. Thus, a relay movable contact 33*a* which is disposed on one end portion of the relay movable touch piece 33 is contactably and separably opposed to the relay fixed contact 32*a* which is swaged to the second relay terminal 32.

Further, the base 20 includes a fitting hole 27 having a step on the back face side of the lower side thereof. A permanent magnet 28 having a step is inserted in the fitting hole 27. The steps of the fitting hole 27 and the permanent magnet 28 are provided for preventing erroneous insertion.

Figure 6:
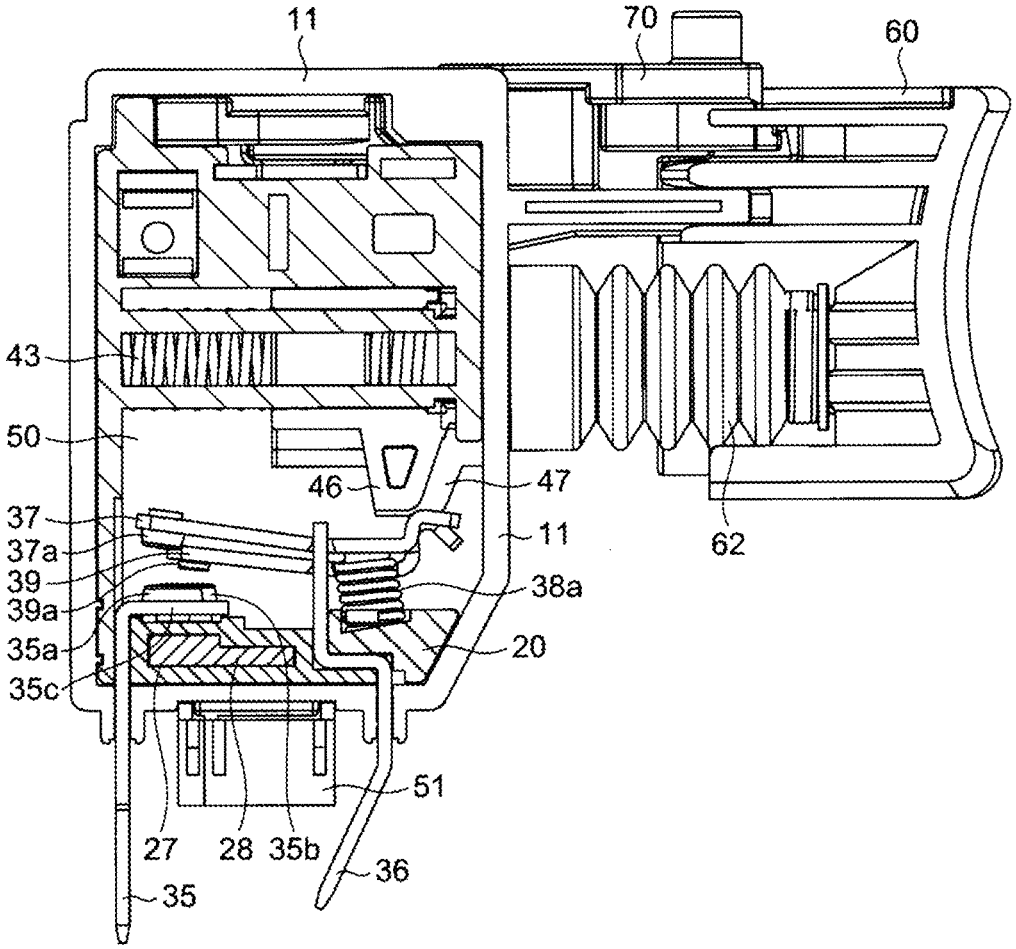
FIG. 6 is a vertical sectional view of a trigger switch, such as in FIG. 1, viewed from a back face side.
Figure 7:
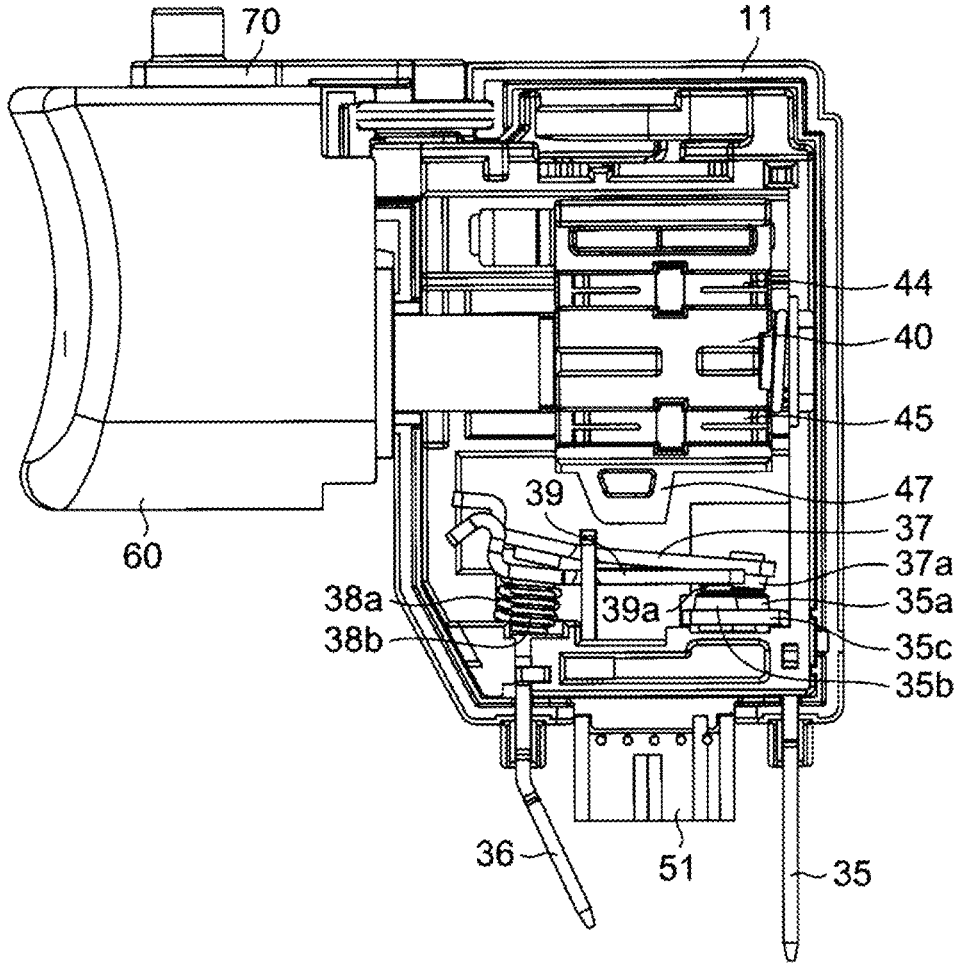
FIG. 7 is a front view illustrating internal components after a trigger switch, such as in FIG. 1, operates.
Figure 8:
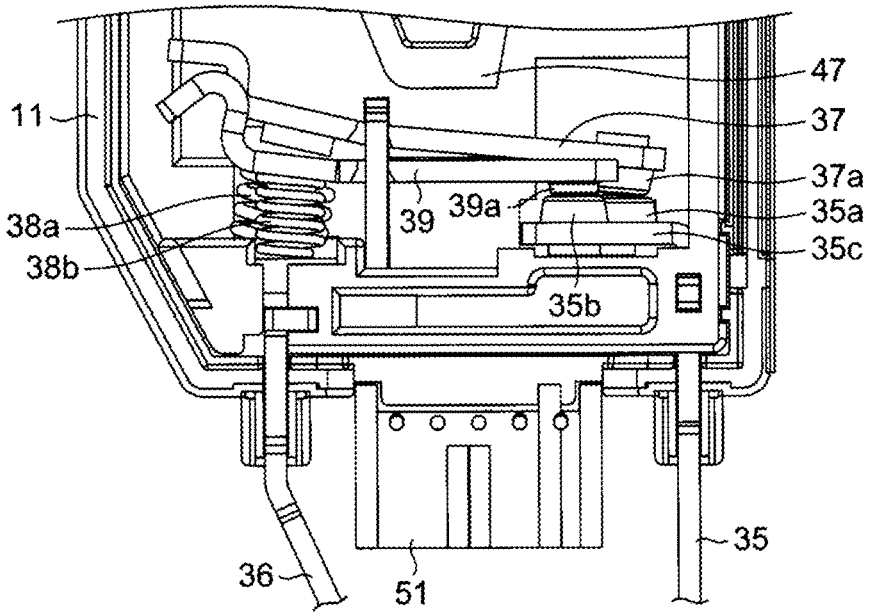
FIG. 8 is a partially enlarged front view of FIG. 7.

As illustrated in FIG. 2, a fixed contact terminal 35 and a movable contact terminal 36 are press-fitted and fixed to the lower side of the base 20 from the lateral side. In particular, as illustrated in FIG. 6, a horizontal end portion 35*c* of the fixed contact terminal 35 with a pair of opening/closing and energizing fixed contacts 35*a*, 35*b* swaged is not buried in the base 20, but supported in a cantilever manner by the base 20.

Thus, even if an arc occurs between the opening/closing fixed contact 35*a* and an opening/closing movable contact 37*a*, impalpable powder is less likely to be produced from a resin that forms the base 20 and less likely to fly into the atmosphere. As a result, the insulation resistance of an internal space is not reduced. In addition, impalpable resin powder is not adhered to the contact surfaces. Therefore, there is an advantage that an arc is less likely to occur when the opening/closing movable contact 37*a* comes close to the opening/closing fixed contact 35*a*, which extends the contact life.

Figure 5:
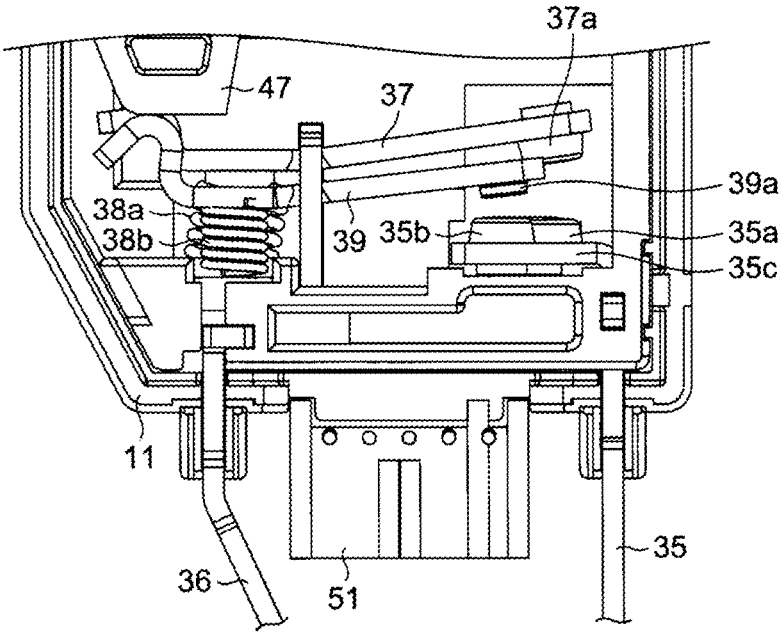
FIG. 5 is a partially enlarged front view of a trigger switch, such as in FIG. 4.

On the other hand, the movable contact terminal 36 includes a support hole 36*a* and a support hole 36*b* which are arranged side by side on the upper end portion of the movable contact terminal 36. Further, an opening/closing movable touch piece 37 is inserted in the support hole 36*a* and turnably supported through the movable contact spring 38*a*. On the other hand, an energizing movable touch piece 39 is inserted in the support hole 36*b* and turnably supported through the movable contact spring 38*b* (FIG. 5). Thus, the opening/closing movable contact 37*a* and an energizing movable contact 39*a* which are disposed on the opening/closing movable touch piece 37 and the energizing movable touch piece 39, respectively, are contactably and separably opposed to the opening/closing fixed contact 35*a* and the energizing fixed contact 35*b* disposed on the fixed contact terminal 35.

As illustrated in FIG. 2, the plunger 40 has an outer shape slidable inside the base 20 and includes a through hole 41 which laterally penetrates the plunger 40. Further, a pair of guide grooves 42*a*, 42*b* are arranged side by side on one outer side face of the plunger 40. A return spring 43 can be inserted into the through hole 41. Sliders 44, 45 can be press-fitted and fixed to the pair of guide grooves 42*a*, 42*b*, respectively. Thus, the plunger 40 can be housed inside the base 20 movably back and forth in the axial direction through the return spring 43.

Further, as illustrated in FIG. 3, the plunger 40 includes an operation portion 46 having a tapered surface and an operation portion 47 having a tapered surface which are arranged side by side on the bottom face of the plunger 40.

As illustrated in FIG. 2, the printed circuit board 50 has a front shape capable of covering an opening of the base 20. A sliding resistor (not illustrated) is printed and an electronic component such as a resistor is mounted on an inward face of the printed circuit board 50. Further, a socket 51 is attached to the lower end portion of the printed circuit board 50. The printed circuit board 50 is fitted into and assembled to the base 20 which houses the plunger 40 therein, and the common relay terminal 30 and the first relay terminal 31 are electrically connected thereto so that the printed circuit board 50 can be integrated with the base 20. The pair of sliders 44, 45 attached to the plunger 40 slides along the sliding resistor on the printed circuit board 50 to change a resistance value by sliding the plunger 40.

As illustrated in FIG. 2, the trigger 60 is provided with the operation shaft 61 which laterally projects and locks one end portion of a bellows tube 62 which is inserted in the operation shaft 61 with a coil ring 63. The trigger 60 can be integrated with the plunger 40 by slide-engaging a leading end portion of the operation shaft 61 which projects from the bellows tube 62 from an engagement hole 40*a* (FIG. 3) of the plunger 40.

The bellows tube 62 inserted in the operation shaft 61 is brought into a waterproof structure by engaging the other end portion of the bellows tube 62 with the semicircular ribs 13, 17 of the first and second covers 11, 15.

As illustrated in FIG. 2, a steel ball 72 is assembled to one end portion of the switching lever 70 through a coil spring 71 in such a manner that the steel ball 72 is biased outward. Further, as illustrated in FIG. 3, a turning touch piece 74 having a gate-like sectional shape is assembled to the lower face of one end side of the switching lever 70 through a coil spring (not illustrated). Further, the switching lever 70 includes a guard portion 75 which is located at an intermediate position thereof and a turning shaft portion 76 which projects immediately under the guard portion 75 on the same axis as the guard portion 75. The turning shaft portion 76 can be positioned in the positioning recess 21 of the base 20. Further, the guard portion 75 can be turnably supported by the semicircular fitting recesses 12, 16 of the first and second covers 11, 15 through a seal ring 77. Thus, when the switching lever 70 is turned around the turning shaft portion 76 as an axis, the turning touch piece 74 (FIG. 3) turns. Accordingly, both ends of the turning touch piece 74 come into contact only with the common relay terminal 30 or come into contact with the common relay terminal 30 and the first relay terminal 31. As a result, an electric circuit of the printed circuit board 50 is switched, which can reverse a rotation direction of a motor (not illustrated).

The steel ball 72 biased by the coil spring 71 is engaged with the click-feeling jagged portion 22 of the base 20. Thus, a click feeling can be obtained by operating the switching lever 70.

As an assembly method, first, the common relay terminal 30, the first relay terminal 31, and the second relay terminal 32 with the relay fixed contact 32*a* swaged are assembled to the base 20. Then, the relay movable touch piece 33 provided with the relay movable contact 33*a* is turnably supported by the support hole 30*a* of the common relay terminal 30 through the relay movable contact spring 34. Thus, the relay movable contact 33*a* is contactably and separably opposed to the relay fixed contact 32*a*.

Then, the fixed contact terminal 35 provided with the opening/closing and energizing fixed contacts 35*a*, 35*b* and the movable contact terminal 36 are assembled to the base 20.

Further, the opening/closing movable touch piece 37 with the opening/closing movable contact 37*a* swaged is inserted into the support hole 36*a* of the movable contact terminal 36. The opening/closing movable touch piece 37 is turnably supported by the support hole 36*a* of the movable contact terminal 36 through the movable contact spring 38*a* whose lower end portion is positioned in the positioning recess 24 of the base 20.

Similarly, the energizing movable touch piece 39 with the energizing movable contact 39*a* swaged is inserted into the support hole 36*b* of the movable contact terminal 36. The energizing movable touch piece 39 is turnably supported by the support hole 36*b* of the movable contact terminal 36 through the movable contact spring 38*b* whose lower end portion is positioned in the positioning recess 25 of the base 20.

Accordingly, the opening/closing movable contact 37*a* and the energizing movable contact 39*a* are contactably and separably opposed to the opening/closing fixed contact 35*a* and the energizing fixed contact 35*b*, respectively.

Then, the sliders 44, 45 are press-fitted and fixed to the guide grooves 42*a*, 42*b* of the plunger 40, respectively. On the other hand, the operation shaft 61 of the trigger 60 is inserted into the bellows tube 62 and locked by the coil ring 63, and the leading end portion of the operation shaft 61 projecting from the bellows tube 62 is slide-engaged with the engagement hole 40*a* formed on the plunger 40 from the lateral side for integration. Further, the plunger 40 is slidably housed in the base 20 with the return spring 43 inserted in the through hole 41. Then, the printed circuit board 50 with the socket 51 attached is fitted into and attached to the opening of the base 20. Then, the common relay terminal 30, the first relay terminal 31, the second relay terminal 32, the fixed contact terminal 35, and the movable contact terminal 36 are electrically connected to the printed circuit board 50.

On the other hand, the seal ring 77 is attached to the guard portion 75 of the switching lever 70. Further, the coil spring 71 and the steel ball 72 are assembled to one end portion of the switching lever 70 through a jig (not illustrated), and a coil spring (not illustrated) and the turning touch piece 74 (FIG. 3) are assembled to the lower face at one end side thereof. Then, the turning shaft portion 76 of the switching lever 70 is turnably positioned in the positioning recess 21 of the base 20. Further, the first and second covers 11, 15 are assembled to the base 20 from both sides thereof to lock the switching lever 70. Then, an opening edge of the seal ring 77 is fitted into the semicircular ribs 13, 17 of the first and second covers 11, 15. Finally, the first and second covers 11, 15 are joined and integrated together by ultrasonic welding or with an adhesive. Accordingly, an assembly operation is completed.

Next, a method for operating the trigger switch will be described.

When the switching lever 70 is located at a neutral position, one end portion of the switching lever 70 abuts against a center projection 60*a* (FIG. 2) of the trigger 60. Accordingly, the trigger 60 cannot be pulled in, which prevents an erroneous operation.

Further, when the switching lever 70 is turned in a counterclockwise direction around the guard portion 75 as an axis, both ends of the turning touch piece 74 come into contact only with the common relay terminal 30. Further, immediately before the trigger 60 is pulled in, the sliders 44, 45 are in contact with the sliding resistor (not illustrated) on the printed circuit board 50 with a maximum resistance value. Further, although the relay movable touch piece 33 is biased by a spring force of the relay movable contact spring 34, the position of the relay movable touch piece 33 is restricted by a step 40*b* (FIG. 2) of the plunger 40. Thus, the relay movable contact 33*a* is separated from the relay fixed contact 32*a*.

On the other hand, although the opening/closing movable touch piece 37 is biased by the movable contact spring 38*a* (FIG. 6), the position of the opening/closing movable touch piece 37 is restricted by the operation portion 46 of the plunger 40 biased by the return spring 43. Thus, the opening/closing movable contact 37*a* is contactably and separably opposed to the opening/closing fixed contact 35*a*.

Similarly, although the energizing movable touch piece 39 which is turnably supported is biased by the movable contact spring 38*b* (FIG. 5), the position of the energizing movable touch piece 39 is restricted by the operation portion 47 of the plunger 40. Thus, the energizing movable contact 39*a* is contactably and separably opposed to the energizing fixed contact 35*b*.

First, when an operator pulls the trigger 60 in, the plunger 40 which is engaged with the operation shaft 61 of the trigger 60 slides. Thus, the sliders 44, 45 assembled to the plunger 40 slide on the printed circuit board 50. As the sliders 44, 45 slide, the resistance value decreases, and flowing current increases. Accordingly, an operation lamp (not illustrated) is turned on.

When the trigger 60 is further pulled in, the position restriction with respect to the relay movable touch piece 33 by the step 40*b* (FIG. 2) of the plunger 40 is released. Accordingly, the relay movable touch piece 33 is turned by the spring force of the relay movable contact spring 34. Thus, the relay movable contact 33*a* comes into contact with the relay fixed contact 32*a*, and a rated current flows in the printed circuit board 50. Substantially simultaneously with this, the position restriction with respect to the opening/closing movable touch piece 37 by the operation portion 46 of the plunger 40 is released. Thus, the opening/closing movable touch piece 37 is turned by the spring force of the movable contact spring 38*a*, and the opening/closing movable contact 37*a* comes into contact with the opening/closing fixed contact 35*a* (refer to FIGS. 7 and 8).

The horizontal end portion 35*c* with the pair of opening/closing and energizing fixed contacts 35*a*, 35*b* swaged is not buried in the base 20, but supported in a cantilever manner by the base 20. Thus, even if an arc occurs when the opening/closing movable contact 37*a* comes close to the opening/closing fixed contact 35*a*, impalpable powder is less likely to be produced from the resin that forms the base 20 and less likely to fly into the atmosphere. Therefore, the insulation resistance of the internal space is not reduced. In addition, impalpable resin powder is not adhered to the contact surfaces. As a result, there is an advantage that an arc is less likely to occur when the opening/closing movable contact 37*a* comes close to the opening/closing fixed contact 35*a*, which extends the contact life.

When the trigger 60 is further pulled in, the operation shaft 61 is pushed into the deep side of the base 20, which releases the position restriction by the operation portion 47 of the plunger 40. Thus, the energizing movable touch piece 39 is turned by the spring force of the movable contact spring 38*b*. Accordingly, the energizing movable contact 39*a* comes into contact with the energizing fixed contact 35*b* (FIG. 8), and a sliding resistance value becomes nearly zero. As a result, the maximum current flows in the sliders 44, 45, a microcomputer (not illustrated) of a tool which receives a resistance value change outputs a signal, and a rotation speed of the motor becomes maximum.

One or more embodiments employ a so-called butting type movable touch piece. Specifically, the opening/closing movable touch piece 37 and the energizing movable touch piece 39 are biased by the spring force of the movable contact springs 38*a*, 38*b*, respectively, to ensure contact pressure. Thus, there is an advantage that a shift in timing of contact between the contacts does not occur, and there is no variation in an opening/closing characteristic.

Then, when the operator loosens the force for pulling the trigger 60 in, the plunger 40 is pushed back by the spring force of the return spring 43, and the sliders 44, 45 slide on the printed circuit board 50 in the opposite direction. Then, the operation portion 47 of the plunger 40 turns the energizing movable touch piece 39 in the direction opposite to the above against the spring force of the movable contact spring 38*b*. Thus, the energizing movable contact 39*a* is separated from the energizing fixed contact 35*b*. Then, the operation portion 46 of the plunger 40 turns the opening/closing movable touch piece 37 in the direction opposite to the above against the spring force of the movable contact spring 38*a*. Thus, the opening/closing movable contact 37*a* is separated from the opening/closing fixed contact 35*a*. Further, the relay movable touch piece 33 is turned by the step 40*b* of the plunger 40 against the spring force of the relay movable contact spring 34, and the relay movable contact 33*a* is separated from the relay fixed contact 32*a*. Thereafter, the sliders 44, 45 return to the original positions thereof.

Figure 9:
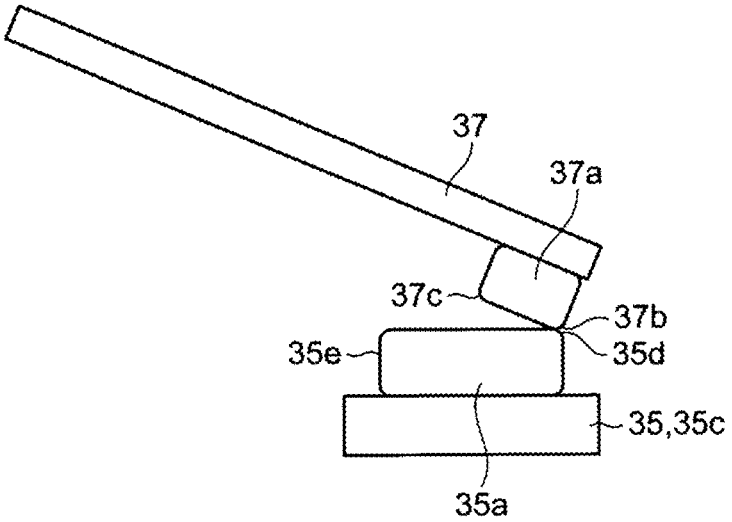
FIG. 9 is a schematic explanatory diagram illustrating closing of contacts of a trigger switch, such as in FIG. 1.
Figure 10:
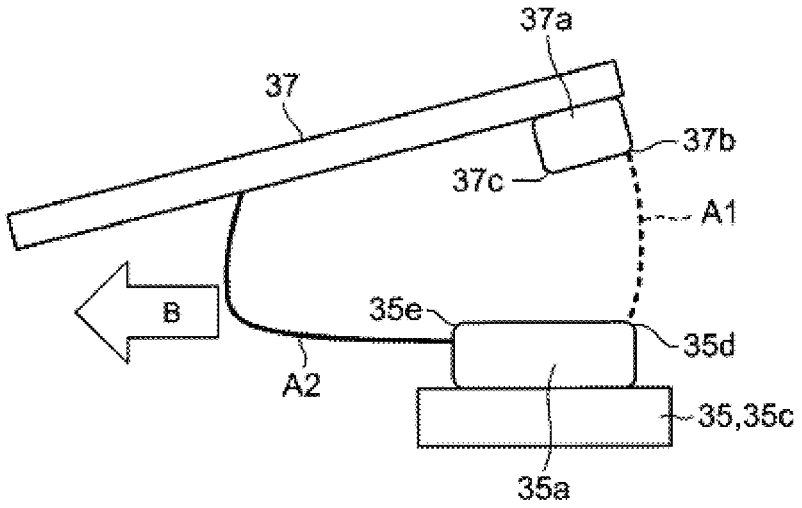
FIG. 10 is a schematic explanatory diagram illustrating a trigger switch, such as in FIG. 1, immediately after opening.

When the opening/closing movable contact 37*a* being in contact with a contact surface region 35*d* of the opening/closing fixed contact 35*a* as illustrated in FIG. 9 is separated from the opening/closing fixed contact 35*a* as illustrated in FIG. 10, an arc A1 occurs between the surface regions that are separated first, that is, between the contact surface region 35*d* of the opening/closing fixed contact 35*a* and a contact surface region 37*b* of the opening/closing movable contact 37*a*. Then, a magnetic force B of the permanent magnet 28 extends the arc A1 occurring between the opening/closing fixed contact 35*a* and the opening/closing movable contact 37*a* in a desired direction.

That is, the magnetic force B of the permanent magnet 28 moves the arc A1 occurring between the contact surface region 37*b* of the opening/closing movable contact 37*a* and the contact surface region 35*d* of the opening/closing fixed contact 35*a* to a non-contact surface region 37*c* and a non-contact surface region 35*e*. Thus, even if the non-contact surface regions 35*e*, 37*c* are partially burn-damaged by a moved arc A2, the contact surface region 37*b* of the opening/closing movable contact 37*a* and the contact surface region 35*d* of the opening/closing fixed contact 35*a* are not burn-damaged. As a result, the electric resistance is not increased, and heat generation is less likely to occur. Thus, a contact mechanism having a long contact life can be obtained.

Further, when the switching lever 70 is turned in a clockwise direction around the guard portion 75 from the neutral position, the steel ball 72 climbs over the click-feeling jagged portion 22, and both ends of the turning touch piece 74 come into contact with the common relay terminal 30 and the first relay terminal 31. Thus, when the trigger 60 is pulled in similarly to the above, the motor rotates in the opposite direction.

Figure 11:
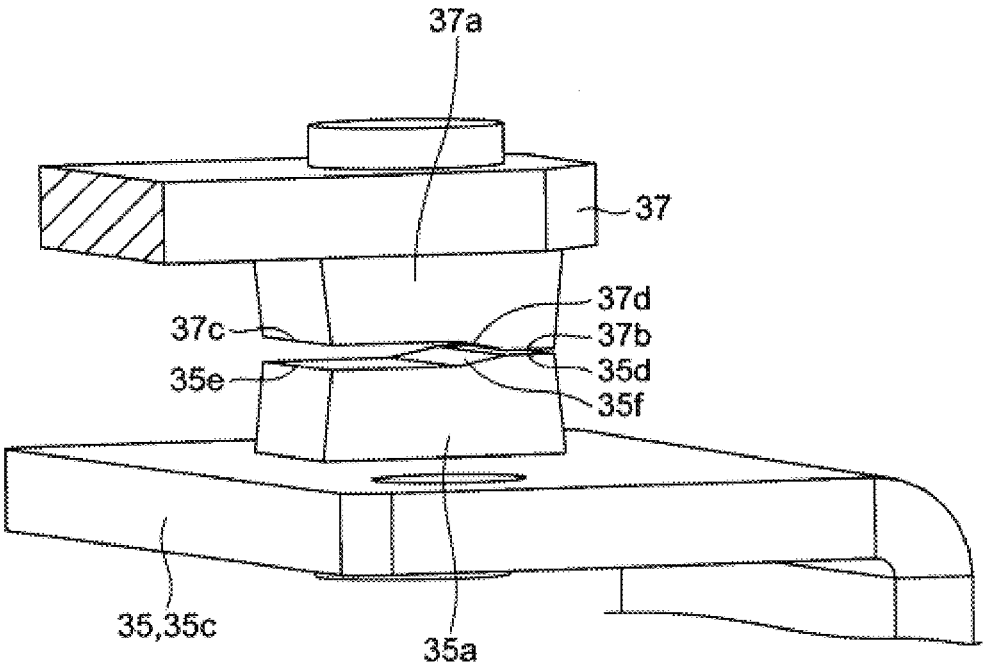
FIG. 11 is a partially enlarged perspective view illustrating a contact mechanism according to one or more embodiments.

The contact mechanism is not limited to a first embodiment described above, and may employ a second embodiment illustrated in FIG. 11.

Specifically, an opening/closing fixed contact 35*a* and an opening/closing movable contact 37*a* according to a second embodiment both have quadrate opposed surfaces. Further, the opening/closing fixed contact 35*a* is provided with a contact surface region 35*d* on one side edge portion of the opposed surface thereof and a non-contact surface region 35*e* on the other side edge portion of the opposed surface. Further, there is a step between the contact surface region 35*d* and the non-contact surface region 35*e*, and the contact surface region 35*d* and the non-contact surface region 35*e* are connected through a tapered surface 35*f*.

Similarly, the opening/closing movable contact 37*a* is provided with a contact surface region 37*b* on one side edge portion of the opposed surface thereof and a non-contact surface region 37*c* on the other side edge portion of the opposed surface. Further, there is a step between the contact surface region 37*b* and the non-contact surface region 37*c*, and the contact surface region 37*b* and the non-contact surface region 37*c* are connected through a tapered surface 37*d*.

According to one or more embodiments, there is the step between the contact surface region 35*d* and the non-contact surface region 35*e*, and the contact surface region 35*d* and the non-contact surface region 35*e* are connected through the tapered surface 35*f*. Thus, there is an advantage that the occurred arc easily moves and disappears.

Each of the tapered surfaces of the opening/closing fixed contact 35*a* and the opening/closing movable contact 37*a* according to one or more embodiments may be a flat tapered surface or may also be a curved tapered surface having a projecting cross section or a recessed cross section.

Although, in one or more embodiments, the movable touch piece turns, the present invention is not limited thereto. The movable touch piece may parallely move the movable contact along an opposed direction that intersects the surface of the fixed contact.

EXAMPLES

Example 1

The trigger switch according to a first embodiment was used as a sample. Further, current of 42V and 130 A was passed, an arc that has occurred when the opening/closing movable contact 37*a* came into contact with the opening/closing fixed contact 35*a* was extended in a direction in which the arc is less likely to strike a resin molded article by the magnetic force of the permanent magnet 28, and the number of arc occurrences and an arc duration during closing of the contacts were measured. A hatched bar in the graph of FIG. 12 indicates a measurement result.

In Example 1, the direction in which the arc during closing of the contacts is less likely to strike the resin molded article is a direction in which the occurred arc during closing of the contacts is extended along the opening/closing movable touch piece 37 and toward the turning axis of the opening/closing movable touch piece 37.

Comparative Example 1

The number of arc occurrences and the arc duration during closing of the contacts were measured under the same condition as Example 1 except that the occurred arc during closing of the contacts was extended in a direction in which the arc strikes the resin molded article. A white bar in the graph of FIG. 12 indicates a measurement result.

In Comparative Example 1, the direction in which the occurred arc during closing of the contacts strikes the resin molded article is a direction in which the arc is extended perpendicularly to the axis of the opening/closing movable touch piece 37 and toward a side wall of the base 20.

Figure 12:
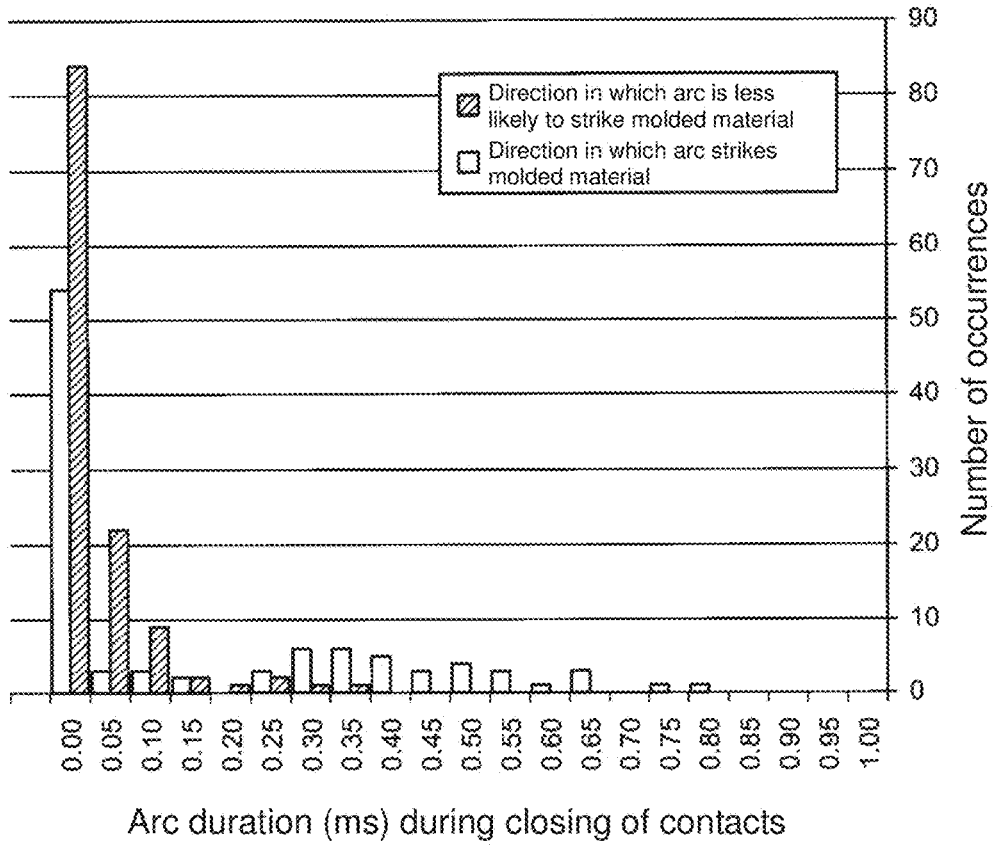
FIG. 12 is a graph illustrating an arc duration during closing of contacts in Example 1 and Comparative Example 1 of a contact mechanism according to one or more embodiments.

As is obvious from FIG. 12, it turned out that an arc is less likely to occur during closing of the contacts in Example 1 than in Comparative Example 1 from the arc duration 0.00, that is, the number of no-arc occurrences during closing of the contacts.

Further, in Example 1, there was no arc having an arc duration of 0.40 or more during closing of the contacts. On the other hand, in Comparative Example 1, an arc having an arc duration of 0.80 or more during closing of the contacts occurred.

It turned out, from the above result, that contact welding is less likely to occur during closing of the contacts in Example 1 than in Comparative Example 1.

Example 2

Figure 13:
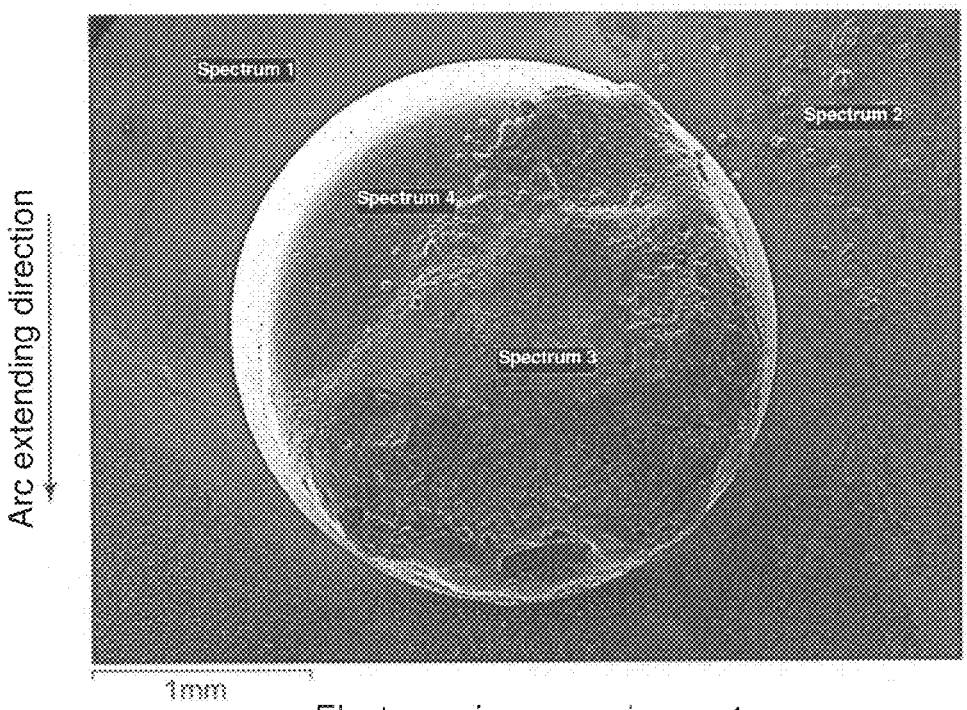
FIG. 13 is a photograph of a fixed contact in Example 2 of a contact mechanism according to one or more embodiments.
Figure 14:
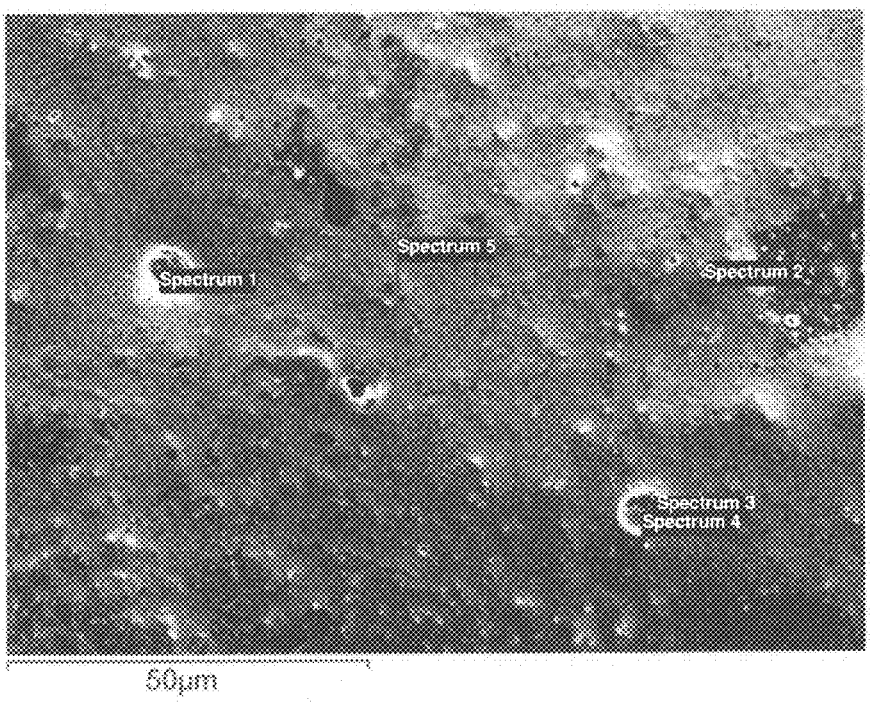
FIG. 14 is a partially enlarged photograph, such as in FIG. 13.
Figure 15:
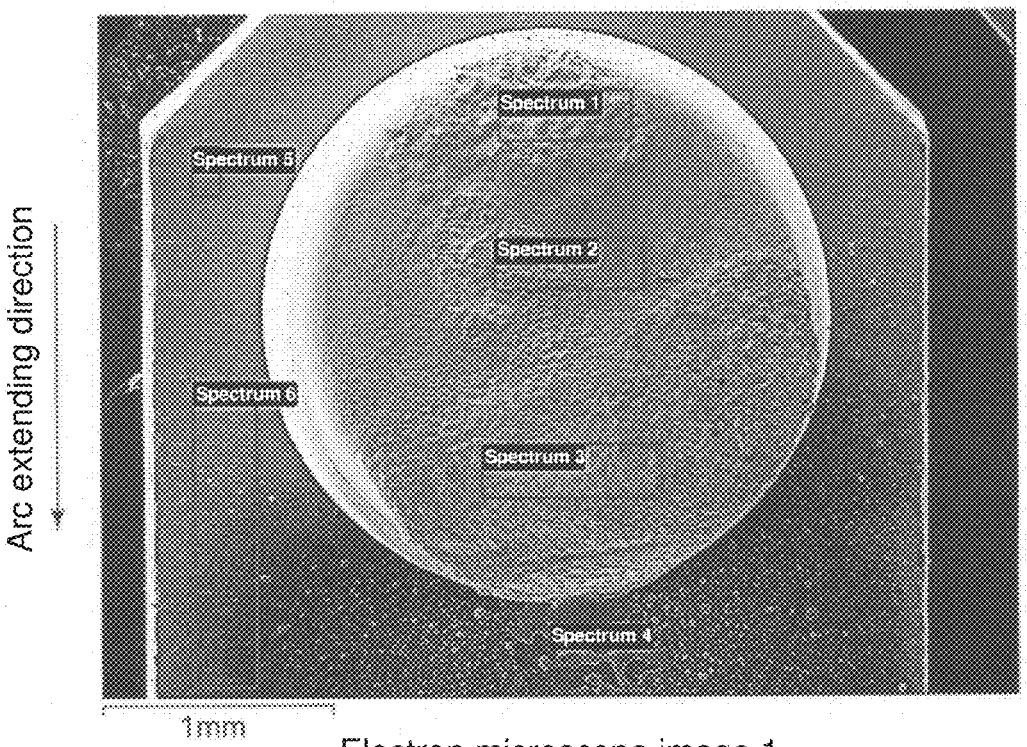
FIG. 15 is a photograph of a movable contact in Example 2 of a contact mechanism according to one or more embodiments.
Figure 16:
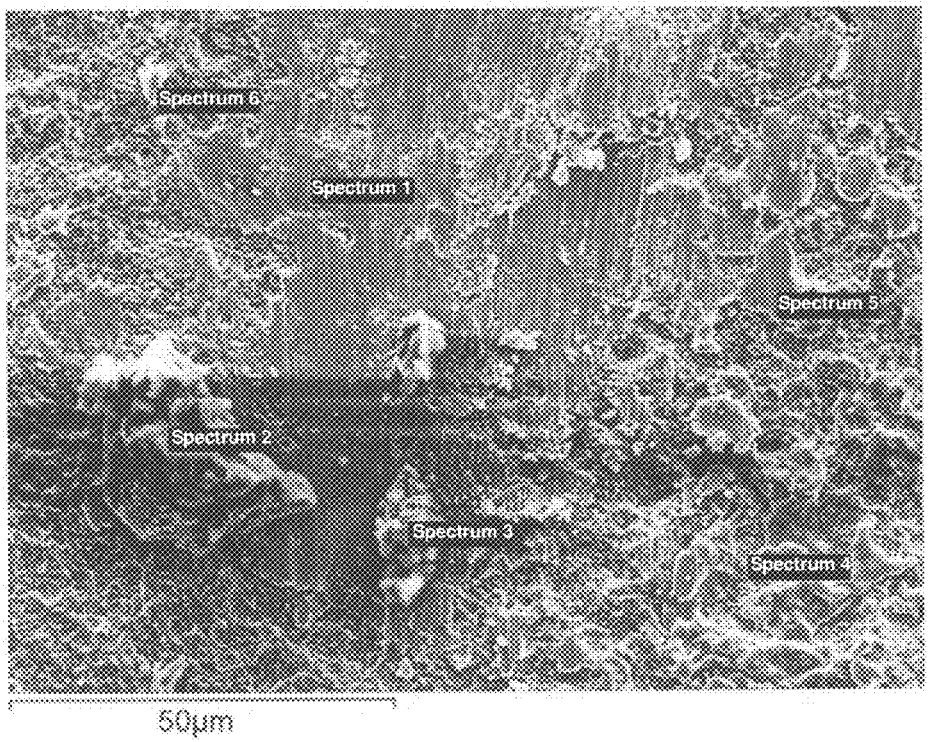
FIG. 16 is a partially enlarged photograph, such as in FIG. 15.

The trigger switch according to a first embodiment was used as a sample. Further, current of 42V and 130 A was passed, an arc during closing of the contacts that has occurred when the opening/closing movable contact 37*a* came into contact with the opening/closing fixed contact 35*a* was extended in a direction in which the arc is less likely to strikes a resin molded article by the magnetic force of the permanent magnet 28, and the contact surfaces were photographed after 100 times of opening/closing. FIGS. 13 and 14 show a photographed result of the opening/closing fixed contact. FIGS. 15 and 16 show a photographed result of the opening/closing movable contact.

Comparative Example 2

Figure 17:
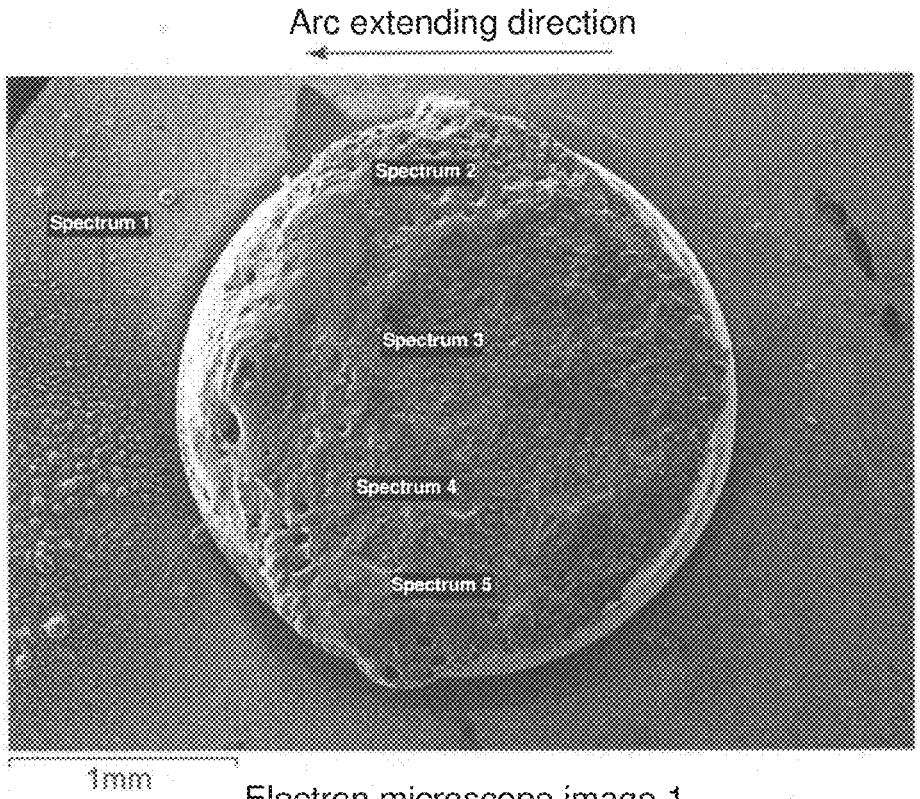
FIG. 17 is a photograph of a fixed contact in Comparative Example 2.
Figure 18:
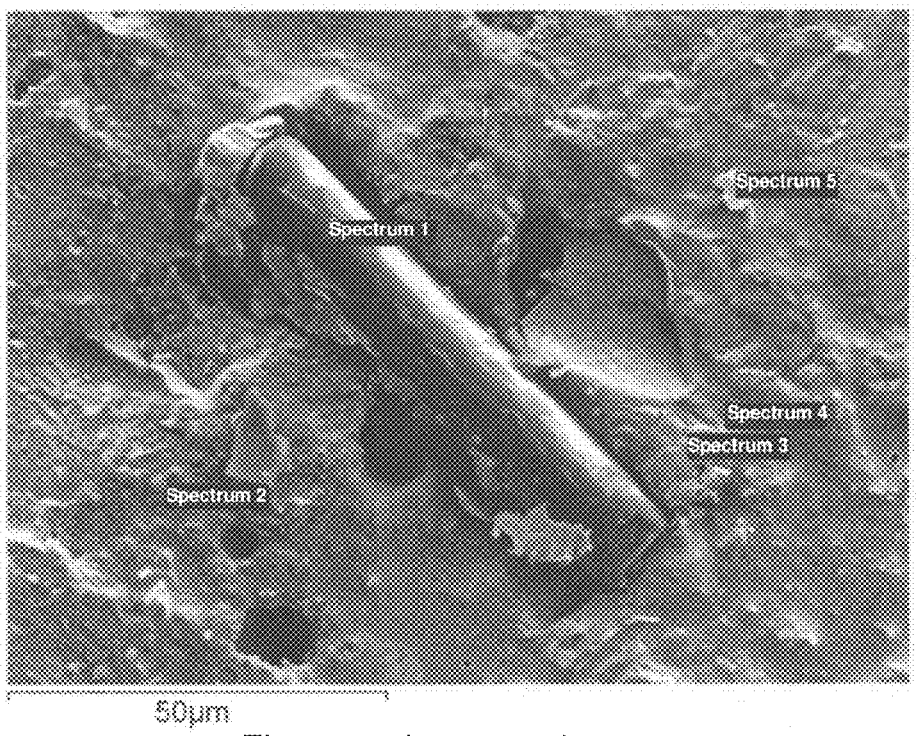
FIG. 18 is a partially enlarged photograph, such as in FIG. 17.
Figure 19:
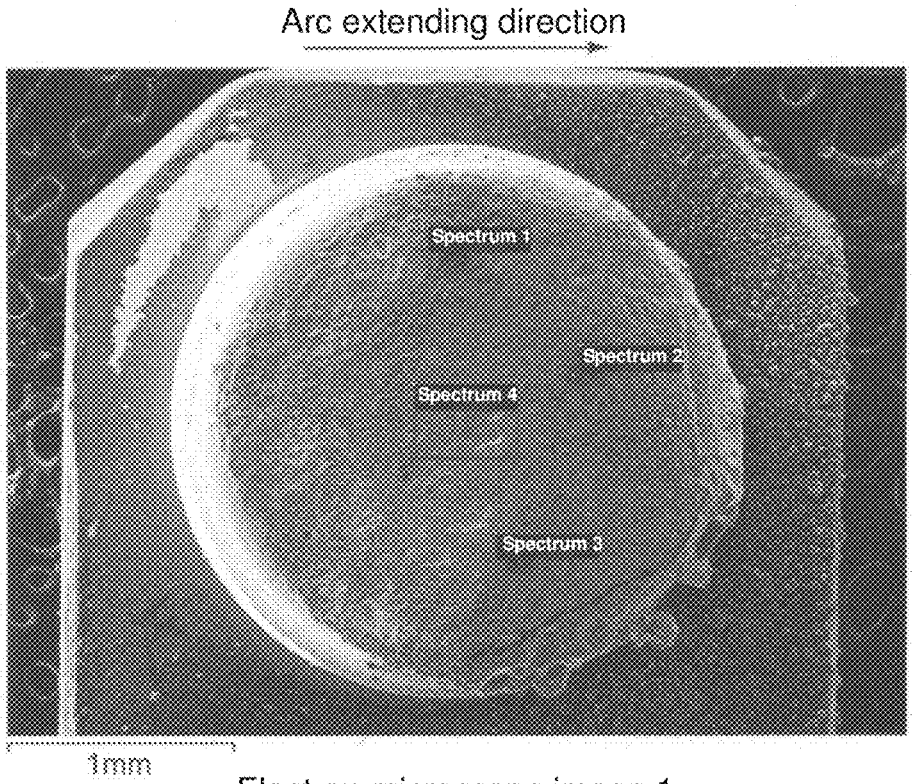
FIG. 19 is a photograph of a movable contact in Comparative Example 2.
Figure 20:
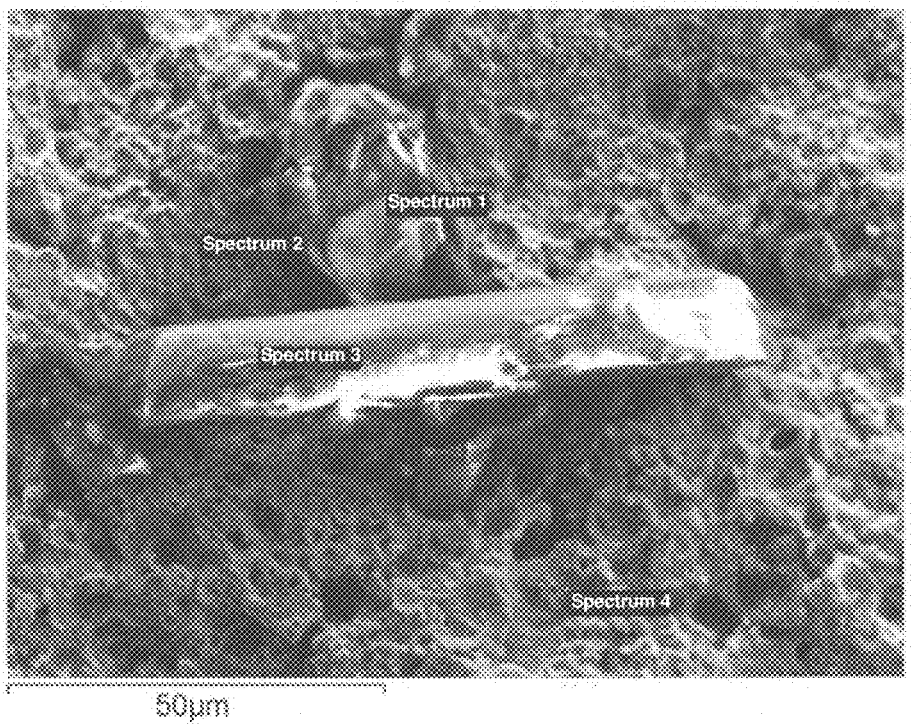
FIG. 20 is a partially enlarged photograph, such as in FIG. 19.

An experiment was performed under the same condition as Example 2 except that the occurred arc during closing of the contacts was extended in a direction in which the arc strikes the resin molded article, and the contact surfaces were then photographed. FIGS. 17 and 18 show a photographed result of the opening/closing fixed contact. FIGS. 19 and 20 show a photographed result of the opening/closing movable contact.

It turned out that the contact surfaces of Example 2 is more beautiful than the contact surfaces of Comparative Example 2 from a comparison between FIGS. 13 to 16 showing Example 2 and FIGS. 17 to 20 showing Comparative Example 2.

Further, it turned out that the amount of adhesion of carbon and glass fiber in Example 2 is extremely smaller than that in Comparative Example 2.

Thus, it turned out that, since the amount of scattering and adhesion of impalpable resin powder in Example 2 is smaller than that in Comparative Example 2 and Example 2 has less air insulation deterioration caused by floating of impalpable resin powder in the atmosphere, an arc is less likely to occur during closing of the contacts in Example 2.

In FIGS. 13 to 20, "spectrum 1" to "spectrum 6" merely indicate positions where optical component analysis is performed.

Example 3

The trigger switch of a first embodiment was used as a sample. Further, current of 42V and 130 A was passed, and the number of openings/closings before the occurrence of contact welding was measured.

Comparative Example 3

An existing trigger switch based on the premise that opposed surfaces are brought into surface contact was used as a sample of Comparative Example 3. Further, the number of openings/closings before the occurrence of contact welding was measured under the same condition as Example 3.

When the number of openings/closings of Example 3 and the number of openings/closings of Comparative Example 3 are compared with each other, the number of openings/closings in Example 3 is approximately four times as many as the number of openings/closings in Comparative Example 3. The number of openings/closings of Comparative Example 3 is sufficient to pass standards for safety. Thus, it turned out that the safety is further improved in Example 3.

INDUSTRIAL APPLICABILITY

It is needless to say that the contact mechanism according to one or more embodiments can be applied not only to the above trigger switch, but also to other switches.

DESCRIPTION OF SYMBOLS

10 housing
11 first cover
15 second cover
20 base
22 click-feeling jagged portion
24 positioning recess
25 positioning recess
28 permanent magnet
30 common relay terminal
30*a* support hole
31 first relay terminal
32 second relay terminal
32*a* relay fixed contact
33 relay movable touch piece
33*a* relay movable contact
34 relay movable contact spring
35 fixed contact terminal
35*a* opening/closing fixed contact
35*b* energizing fixed contact
35*c* horizontal end portion
35*d* contact surface region
35*e* non-contact surface region
36 movable contact terminal
36*a* support hole
36*b* support hole
37 opening/closing movable touch piece
37*a* opening/closing movable contact
37*b* contact surface region
37*c* non-contact surface region
38*a* movable contact spring
38*b* movable contact spring
39 energizing movable touch piece
39*a* energizing movable contact
40 plunger
40*a* engagement hole
40*b* step
41 through hole
43 return spring
44 slider
45 slider

46 operation portion
47 operation portion
50 printed circuit board
51 socket
60 trigger
61 operation shaft
70 switching lever
75 guard portion
76 turning shaft portion
77 seal ring
A1, A2 arc
B magnetic force

The invention claimed is:

1. A contact mechanism comprising:

a fixed contact comprising a first opposed surface including a first contact surface region and a first non-contact surface region;

a movable contact disposed on a movable touch piece and turnable with respect to the fixed contact about a turning axis, the movable contact comprising a second opposed surface opposed to the first opposed surface of the fixed contact, wherein the second opposed surface comprises a second contact surface region and a second non-contact surface region such that in a close state of the fixed and movable contacts, the first and second contact surface regions make contact with each other and the first and second non-contact surface regions make no contact with each other; and a permanent magnet provided such that a magnetic force of the permanent magnet extends an arc that occurs between the first and second contact surface regions in a predetermined direction and moves the arc to at least one of the first and second non-contact surface regions.

2. The contact mechanism according to claim 1, wherein the arc that occurs between the first contact surface region of the fixed contact and the second contact surface region of the movable contact is extended by the magnetic force of the permanent magnet to the first and second non-contact surface regions located at a side corresponding to a turning axis of the movable touch piece.

3. The contact mechanism according to claim 1, wherein at least either the first opposed surface of the fixed contact or the second opposed surface of the movable contact comprises a tapered surface inclined to expand a distance between the fixed contact and the movable contact from the first and second contact surface regions to the first and second non-contact surface regions in the closed state of the fixed contact and the movable contact.

4. A switch comprising the contact mechanism according to claim 1.

5. A trigger switch comprising the contact mechanism according to claim 1.

6. The contact mechanism according to claim 1, wherein the first opposed surface of the fixed contact and the second opposed surface of the movable contact comprise a flat surface.

7. The contact mechanism according to claim 1, wherein the fixed contact is disposed between the permanent magnet and the movable contact.

* * * * *